US006575443B2

(12) United States Patent
Kick

(10) Patent No.: US 6,575,443 B2
(45) Date of Patent: Jun. 10, 2003

(54) SWIVEL-BASE WORK-MANIPULATING PLATFORM

(75) Inventor: Thomas J. Kick, St. Peters, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/911,579

(22) Filed: Jul. 24, 2001

(65) Prior Publication Data

US 2003/0020226 A1 Jan. 30, 2003

(51) Int. Cl.[7] ..... B25B 1/22
(52) U.S. Cl. ..... 269/75; 269/21
(58) Field of Search ..... 269/75, 71, 89, 269/99, 129, 135, 191, 21, 76

(56) References Cited

U.S. PATENT DOCUMENTS 4,066,231 A 1/1978 Bahner et al.
4,306,709 A * 12/1981 Hurn ..... 269/139
4,333,132 A 6/1982 Paley
4,491,306 A * 1/1985 Eickhorst ..... 269/21
5,271,651 A 12/1993 Blatt et al.
5,314,174 A 5/1994 Hagman
5,395,098 A * 3/1995 Eickhorst et al. ..... 269/21
5,465,946 A 11/1995 Smith
5,544,968 A * 8/1996 Goellner ..... 248/181.1
5,607,268 A * 3/1997 Edis et al. ..... 269/21
5,738,344 A 4/1998 Hagman
5,828,224 A * 10/1998 Maruyama ..... 269/71
6,012,711 A * 1/2000 Cipolla ..... 269/21

* cited by examiner

*Primary Examiner*—Lee D. Wilson
(74) *Attorney, Agent, or Firm*—Harness Dickey & Pierce P.L.C.

(57) ABSTRACT

A swivel-base work platform is disclosed that comprises a hemisphere unit rotatably disposed within a base unit, wherein a work piece is secured to a work surface of the hemisphere unit and is manipulated to a variety of positions. The swivel-base work platform further comprises a hard-stop disk disposed at a lower end of the hemisphere unit, which engages the base unit in order to limit rotation of the hemisphere unit and the work piece. Further, the size of the hard-stop disk may be varied to adjust the range of motion of the hemisphere unit. Preferably, the work piece is secured to the work surface of the hemisphere unit using a vacuum source.

21 Claims, 7 Drawing Sheets

SWIVEL-BASE WORK-MANIPULATING PLATFORM

FIELD OF THE INVENTION

The present invention relates generally to workholders or work platforms and more particularly to work platforms that are rotatably positioned to manipulate the position of a work piece.

BACKGROUND OF THE INVENTION

During manual fabrication of parts and components in manufacturing operations, operators are often required to handle and manipulate the parts and components, hereinafter referred to as work pieces, along with associated tooling, in order to perform work on the work piece. For example, in the fabrication of composite parts for aircraft structures, individual composite plies are layed-up over metal bond jigs to form the geometry of the structure. The metal bond jigs vary widely in shape and size, and bond jigs for smaller parts such as wing ribs and fuselage frames that may be manually manipulated generally range between approximately one (1) and twenty five (25) pounds. After the composite plies are cured over the bond jigs, the plies are generally trimmed to a final shape for further assembly operations.

During lay-up and trim operations, an operator frequently picks up and handles the bond jig and accordingly, many operators suffer musculoskeletal problems due to sustained handling during both lay-up of the composite plies and trimming of the composite plies after cure. Known musculoskeletal problems include muscle, tendon, ligament, blood vessel, and nerve damage, along with carpal tunnel syndrome, epicondylitis, and rotator cuff tendonitis. Additionally, many operators cut and injure themselves during trimming operations when one hand is being used to hold the bond jig and the other hand is used to trim the plies. Further, many operators forego the use of mandatory cotton work gloves in order to achieve a better handle on the bond jig and work piece. As a result, injuries to the operators occur and the costs of manufacturing operations increase dramatically.

Devices are known in the art for holding work pieces, often referred to as workholders, which are available in a variety of configurations depending on the work piece to be manipulated. For example, U.S. Pat. No. 5,738,344 to Hagman discloses an ergonomic work piece positioner that includes a relatively complicated system of springs that are controlled by a fluid source, which also acts upon a piston that holds and releases the position of a work piece. Generally, the work piece is secured to the positioner using a threaded arm, wherein the work piece is threaded onto the positioner. Similarly, U.S. Pat. No. 5,314,174, also to Hagman, discloses a spring pneumatic control system, wherein a pneumatic source holds and releases the position of a work piece. Unfortunately, the positioners are relatively complicated and require the use of a foot pedal to activate a control system rather than manipulating the work piece by hand. Further, installation and removal of the work piece is relatively time consuming.

Additional workholders are commercially available and include ball joint devices, wherein the ball joint generally rotates 360° and pivots 90° to position a work piece. The ball joint devices generally comprise a slot, or a knob that controls a split ball, to limit the position of the ball joint, along with a lever to reposition the work as necessary. Therefore, the work piece is manipulated using a mechanical lever, which is positioned a distance away from the center of gravity of the work piece. As a result, a moment is created between the lever and the work piece when the work piece is manipulated by an operator, which may cause an awkward force to manipulate heavier work pieces. Further, the work piece is secured to the workholder using mechanical fasteners, which results in additional time to secure and remove the work piece from the workholder.

Accordingly, there remains a need in the art for a relatively simple and cost effective device to manipulate the position of a work piece, wherein handling by an operator is minimized. Further, the device should provide for ease of securing and removing a work piece to and from the device to facilitate more efficient manufacturing operations.

SUMMARY OF THE INVENTION

In one preferred form, the present invention provides a swivel-base work platform that comprises a hemisphere unit rotatably disposed within a base unit, wherein a hard-stop disk disposed at a lower portion of the hemisphere unit limits the rotation of the hemisphere unit by engaging the base unit. Further, the hemisphere unit comprises a work surface disposed at an upper portion thereof, and thus a work piece, such as a part and/or a tool, may be secured to the work surface and manipulated as desired by an operator.

The base unit further comprises a hemisphere cradle that defines a concave inner surface and an aperture. Accordingly, the hemisphere unit is disposed within the aperture, wherein a convex surface of the hemisphere unit engages the concave inner surface of the hemisphere cradle, thereby allowing the hemisphere unit to rotate within the base unit. Further, the hard-stop disk engages a lower surface of the hemisphere cradle to limit the position of the hemisphere unit and thus the work piece. With a larger hard-stop disk, the range of motion of the hemisphere unit decreases, while a smaller hard-stop disk increases the range of motion of the hemisphere unit. Accordingly, the size of the hard-stop disk may be adjusted for the desired range of motion. Moreover, the shape of the hard-stop disk may be circular or rectangular, among other shapes, to further limit the range of motion of the work piece.

Furthermore, the base unit preferably comprises a base plate spaced apart from the hemisphere cradle and a plurality of support legs secured between the hemisphere cradle and the base plate. Accordingly, the support legs provide a space between the hemisphere cradle and the base plate, thereby providing access to the lower portion of the hemisphere unit, the hard-stop disk, and the vacuum line if applicable. Moreover, the base plate provides for a mobile configuration such that the swivel-base work platform may be used at a variety of work stations throughout a manufacturing facility.

Preferably, a vacuum source is used to secure the work piece to the work surface. Accordingly, the hemisphere unit, the work surface, and the hard-stop disk further comprise concentric apertures, wherein a vacuum line is disposed therethrough. The end of the vacuum line is disposed proximate the work surface at a vacuum port and thus the work piece is secured to the work surface by vacuum at the vacuum port. Additionally, a swivel fitting is preferably employed at the end of the vacuum line proximate the work surface so that the hemisphere unit may be rotatably disposed independent of the vacuum line and further to prevent twisting of the vacuum line.

Alternately, additional attachment devices other than a vacuum source may be used such as a magnetic source, cam or screw clamping, positioning pins, or restraining fences, among others. Accordingly, the reference to a vacuum source to secure the work piece shall not be construed as limiting the scope of the present invention.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
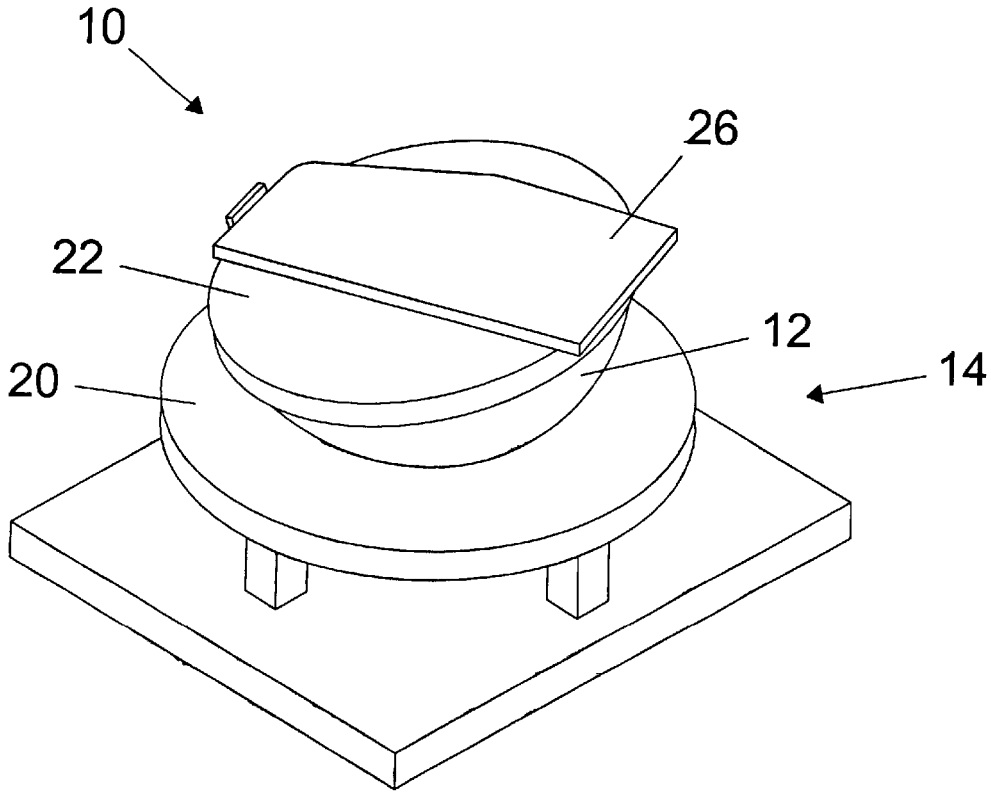
FIG. 1 is an orthogonal view of a swivel-base work platform with a work piece secured thereto in accordance with the present invention.
Figure 2:
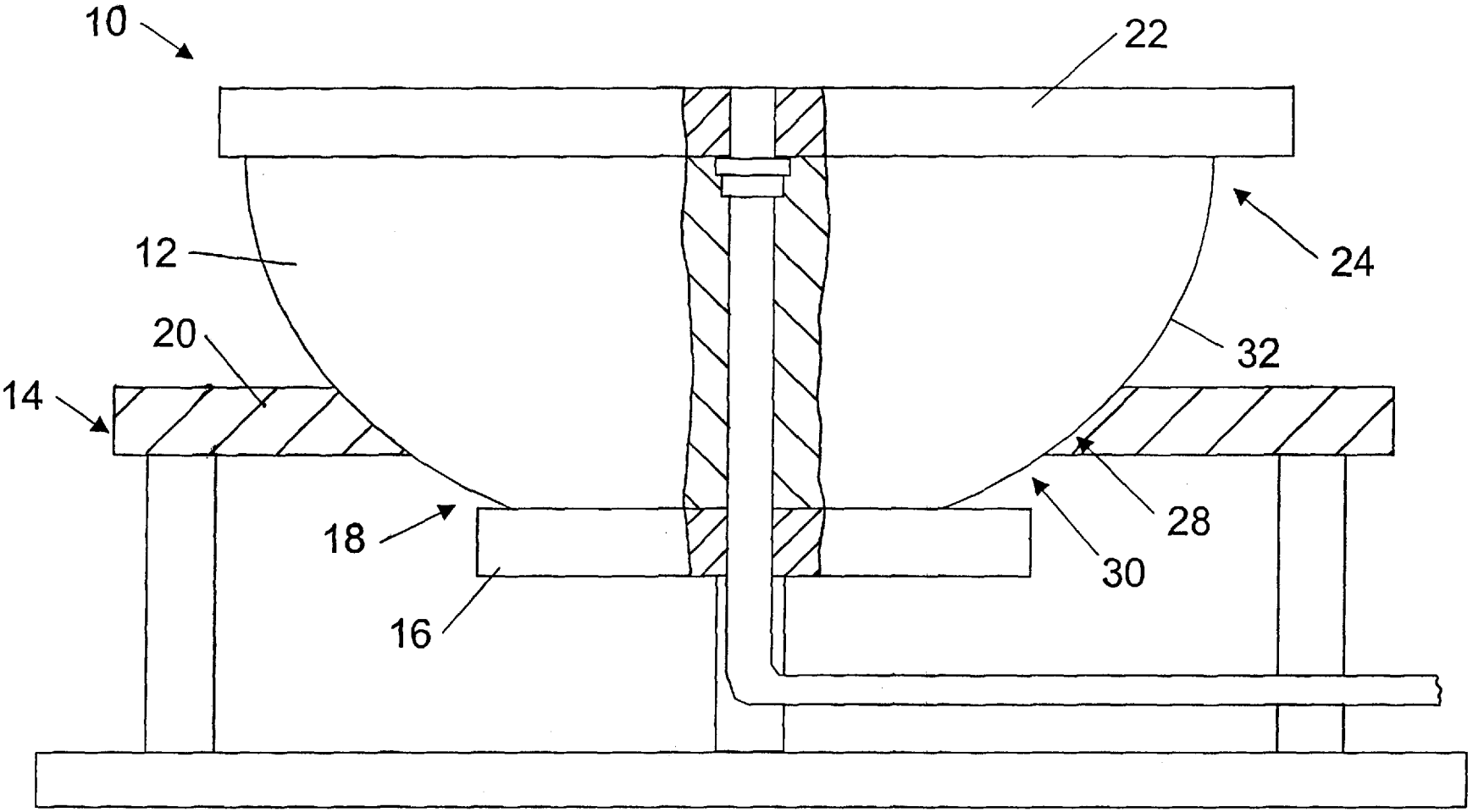
FIG. 2 is a side cross-sectional view of a swivel-base work platform in accordance with the present invention.

Referring to the drawings, the swivel-base work platform according to the present invention is illustrated and generally indicated by reference numeral 10 in FIGS. 1 and 2. The swivel-base work platform 10 comprises a hemisphere unit 12 rotatably disposed within a base unit 14 and a hard-stop disk 16 disposed at a lower portion 18 of the hemisphere unit 12. As the hemisphere unit 12 rotates within the base unit 14, the hard-stop disk 16 engages a hemisphere cradle 20 in order to limit the range of motion, or rotation, of the hemisphere unit 12 as described in greater detail below.

As further shown, the hemisphere unit 12 comprises a work surface 22 disposed at an upper portion 24 thereof. Accordingly, a work piece 26 is secured to the work surface 22, as described in greater detail below, and may be positioned according to specific operator requirements by rotating the work piece 26 itself or the hemisphere unit 12. Preferably, the work surface 22 and the hard-stop disk 16 are circular in shape, although other shapes such as rectangular or polygonal, among others, may also be employed according to the size and shape of the work piece, along with the desired range of motion of the hemisphere unit 12.

As illustrated, the hemisphere cradle 20 defines a concave inner surface 28 and an aperture 30. Accordingly, the hemisphere unit 12 is disposed within the aperture 30, and a convex surface 32 of the hemisphere unit 12 engages the concave inner surface 28 of the hemisphere cradle 20, which allows the hemisphere unit 12 to rotate within the hemisphere cradle 20. Further, the size of the hemisphere unit 12 and the hemisphere cradle 20, along with the convex surface 32 and the concave inner surface 28, may be adjusted according to the size and weight of the work piece that is secured to the swivel-base work platform 10.

Preferably, the lower portion 18 of the hemisphere unit 12 is flat so that the hard-stop disk 16 may be easily secured thereto. The hard-stop disk 16 is preferably secured using a mechanical fastener, although other methods commonly known in the art may also be employed. Further, the hemisphere unit 12, the work surface 22, and the hard-stop disk 16 are preferably fabricated from a lightweight yet durable material such as aluminum.

Figure 3:
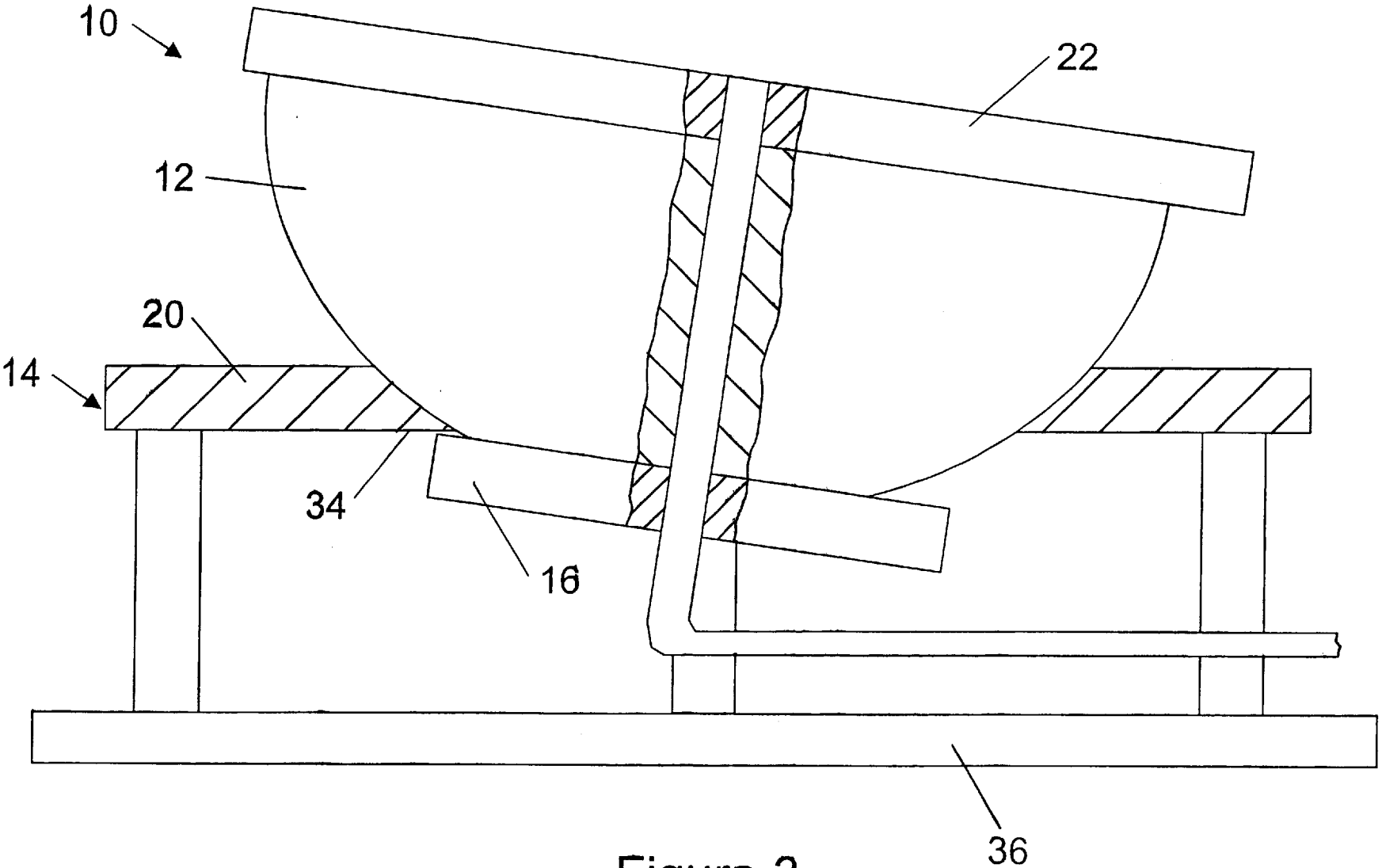
FIG. 3 is a side cross-sectional view of a hard-stop disk engaging a hemisphere cradle to position a work piece in accordance with the present invention.

Referring to FIG. 3, the range of motion, or rotation, of the hemisphere unit 12 is controlled by the hard-stop disk 16 engaging a lower surface 34 of the hemisphere cradle 20 as shown. As the work piece 26 (not shown) or the hemisphere unit 12 is rotated, the hard-stop disk 16 engages the hemisphere cradle 20 to limit the range of motion. With a larger hard-stop disk 16, the range of motion of the hemisphere unit 12 decreases, and conversely, with a smaller hard-stop disk 16, the range of motion of the hemisphere unit 12 increases. Accordingly, the range of motion or amount of rotation of the hemisphere unit 12 may be adjusted by varying the size of the hard-stop disk 16.

Further, the range of motion of the hemisphere unit 12 may further be limited by changing the shape of the hard-stop disk 16. For example, a square shape may be employed rather than a circular shape to limit the range of motion of the hemisphere unit 12 to four specific positions. Other shapes may also be employed according to the teachings of the present invention, and the reference to a circular or square shape for the hard-stop disk 16 shall not be construed as limiting the scope of the present invention.

Figure 4:
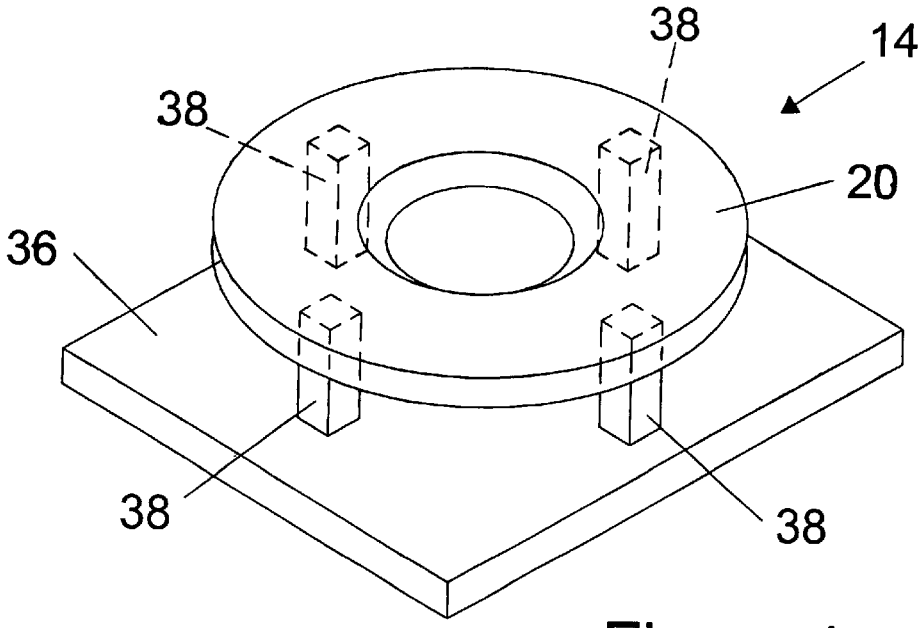
FIG. 4 is an orthogonal view of a base unit in accordance with the present invention.

Referring now to FIG. 4, the base unit 14 generally comprises the hemisphere cradle 20 as previously described, along with a base plate 36 and a plurality of support legs 38. As shown, the base plate 36 is spaced apart a distance from the hemisphere cradle 20 as defined by the length of the support legs 38, which may be adjustable according to the size of the hemisphere unit 12 (not shown). Accordingly, the lower portion of the hemisphere unit 12 may be accessed in order to remove and install the hard-stop disk 16, along with other elements of the present invention as described in further detail below. Furthermore, with the use of a base plate 36, the entire swivel-base work platform 10 is mobile and may be moved to a variety of locations within a manufacturing facility. Preferably, the hemisphere cradle 20, the support legs 38, and the base plate 36 are a durable material such as steel and are preferably welded together. Alternately, the hemisphere cradle 20, the support legs 38, and the base plate 36 may be a light weight material such as nylon, among other materials commonly known in the art.

Figure 5:
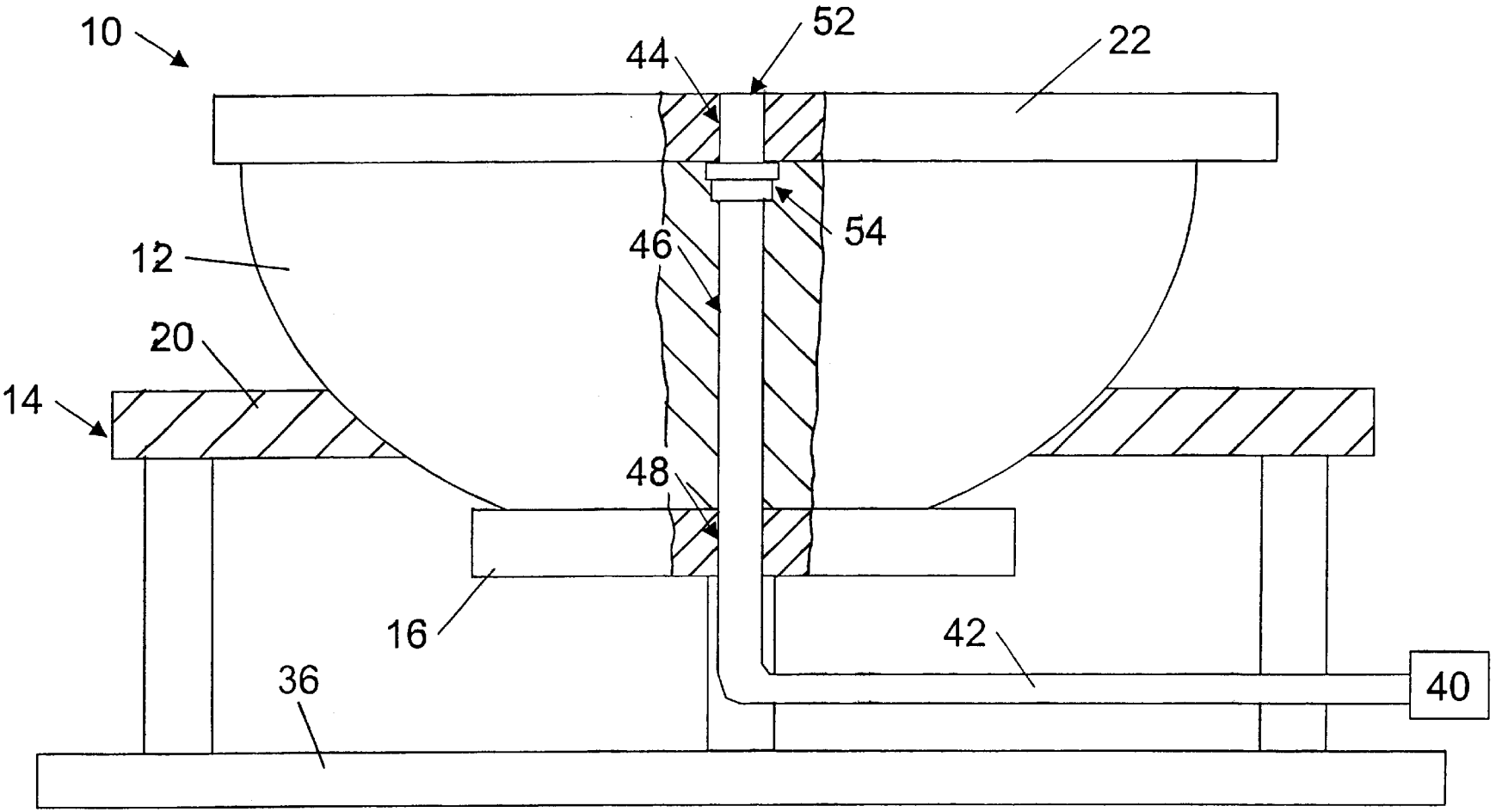
FIG. 5 is a side cross-sectional view of a vacuum source in accordance with the present invention.

In one form of the present invention, the work piece 26 (not shown) is secured to the work surface 22 using a vacuum source 40 as shown in FIG. 5. Generally, the vacuum source 40 comprises a vacuum line 42 that is disposed through the center of the swivel-base work platform 10. More specifically, the work surface 22, the hemisphere unit 12, and the hard-stop disk 16 define concentric apertures 44, 46, and 48, respectively, through which the vacuum line 42 is disposed. Accordingly, the end of the vacuum line 42 is exposed at a vacuum port 52 on the work surface 22 and thus provides a force to secure the work piece 26 (not shown) to the work surface 22 when the vacuum source 40 is activated. Further, a gasket (not shown) may be employed around the vacuum port 52 to further secure the work piece 26 (not shown) if the gasket is compatible with the material of the work piece 26. In another form, a plurality of vacuum lines 42 may be employed inside the hemisphere unit 12 to accommodate larger and heavier work pieces 26 in accordance with the teachings of the present invention.

As further shown, the vacuum source 40 preferably comprises a swivel fitting 54 disposed near the end of the vacuum line 42 proximate the vacuum port 52. Accordingly, the vacuum line 42 does not limit the range of motion of the hemisphere unit 12, and further, the vacuum line 42 is not subject to being twisted during operation of the swivel-base work platform 10. Additionally, the vacuum source 40 is preferably secured to the hemisphere unit 12 using mechanical fasteners and/or fittings (not shown) as commonly known in the art.

In other preferred forms, the work piece 26 may be secured to the work surface 22 using other devices such as a magnetic source, cam or screw clamping, positioning pins, or restraining fences, among others (not shown). Accordingly, the description of the vacuum source 40 to secure the work piece 26 shall not be construed as limiting the scope of the present invention.

Figure 6:
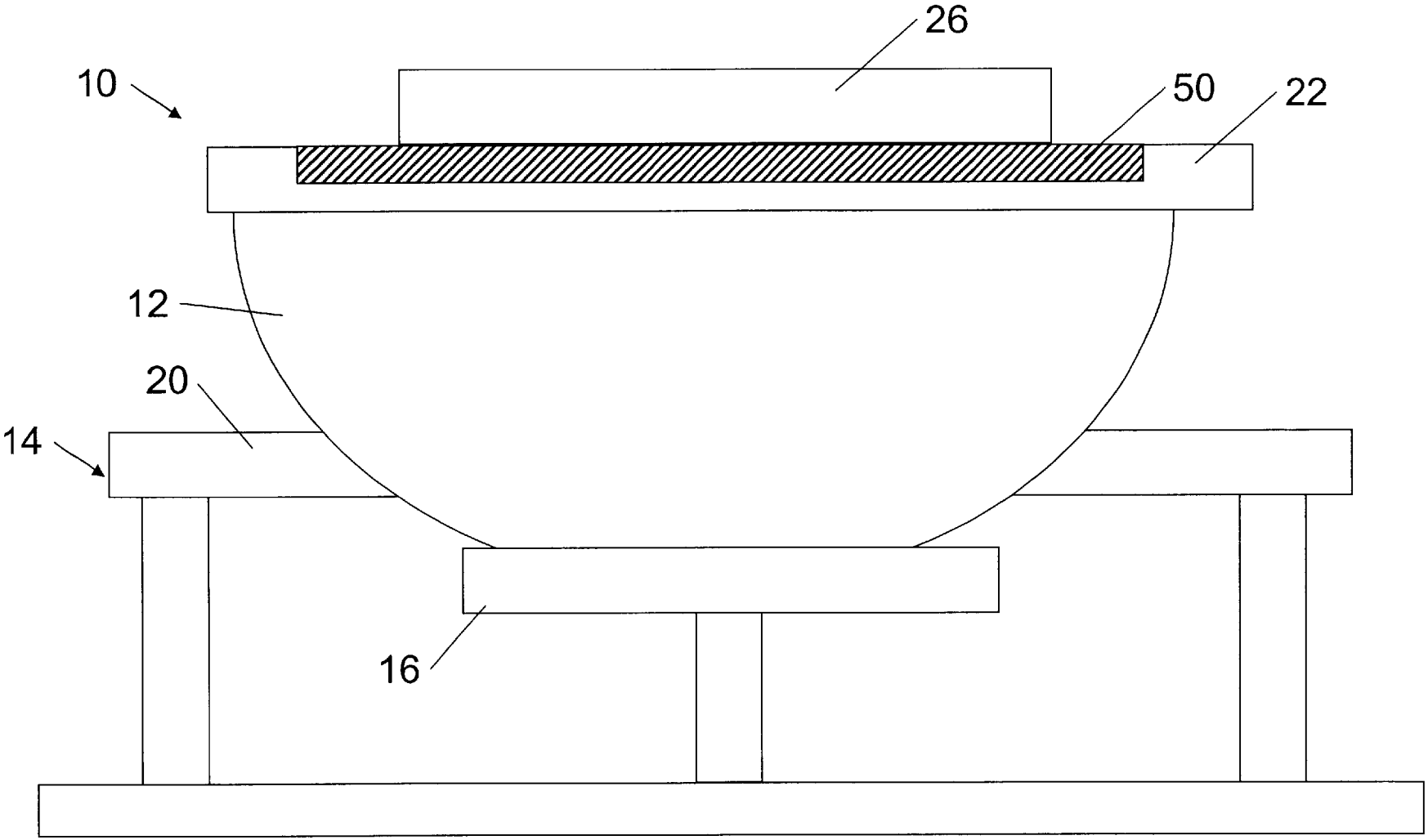
FIG. 6 is a side cross-sectional view of a magnetic source disposed on a swivel-base work platform in accordance with the present invention.

Referring to FIG. 6, a magnetic source 50 is disposed proximate the work surface 22 as an alternate device to secure the work piece 26 as shown. The magnetic source 50 may be activated by any source commonly known in the art such as a power supply, wherein the source activates the magnetic source 50 to produce a magnetic field that secures the workpiece 26 to the work surface 22.

Figure 7:
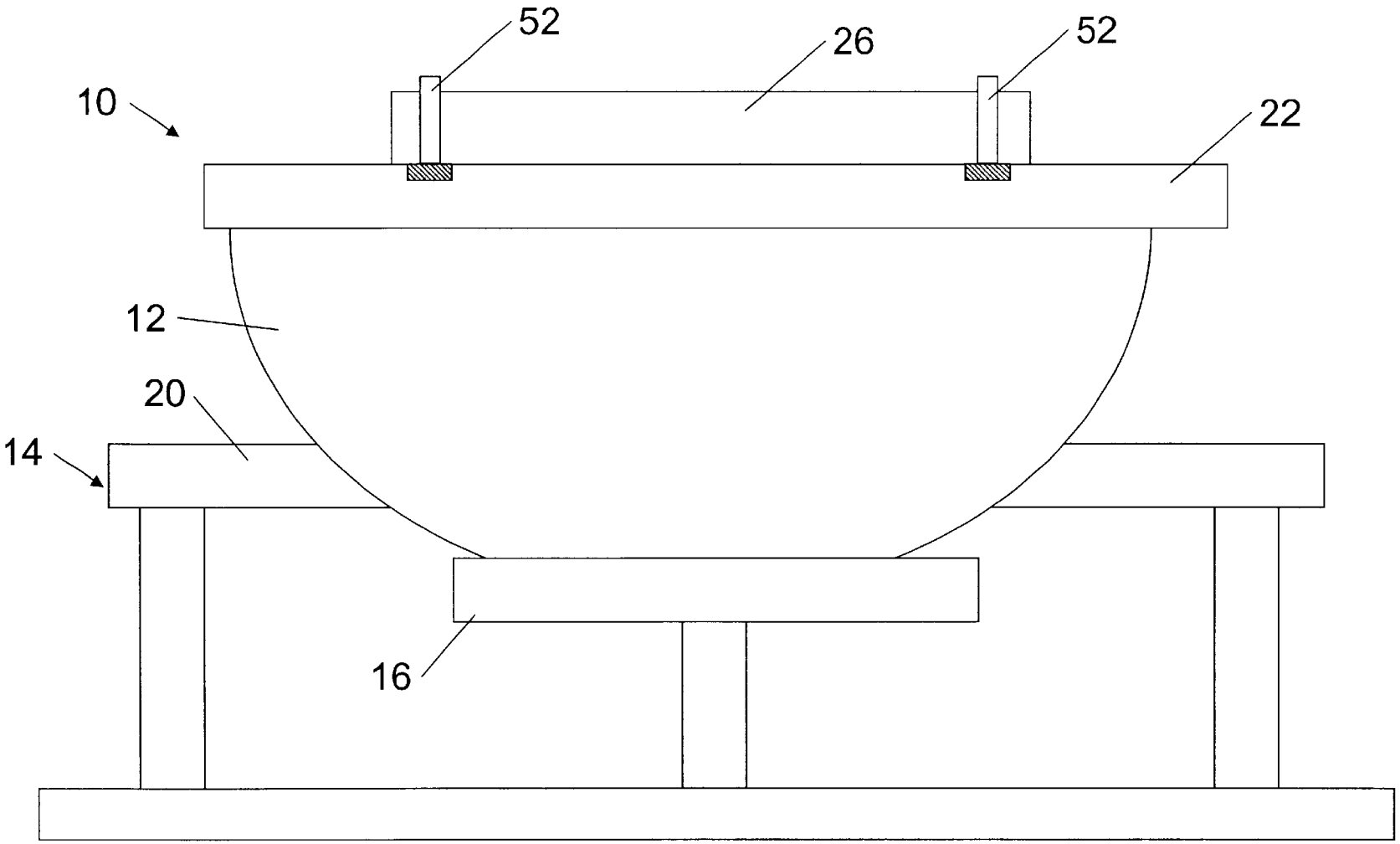
FIG. 7 is a side cross-sectional view of positioning pins disposed on a swivel-base work platform in accordance with the present invention.

Alternately, as shown in FIG. 7, the work piece 26 may be secured to the work surface 22 using positioning pins 52. The positioning pins 52 preferably extend through the work piece 26, which comprises holes or apertures to accommodate the positioning pins 52. Further, the positioning pins 52 and are secured to the work surface 22 as shown to hold the work piece 26 in place.

Figure 8:
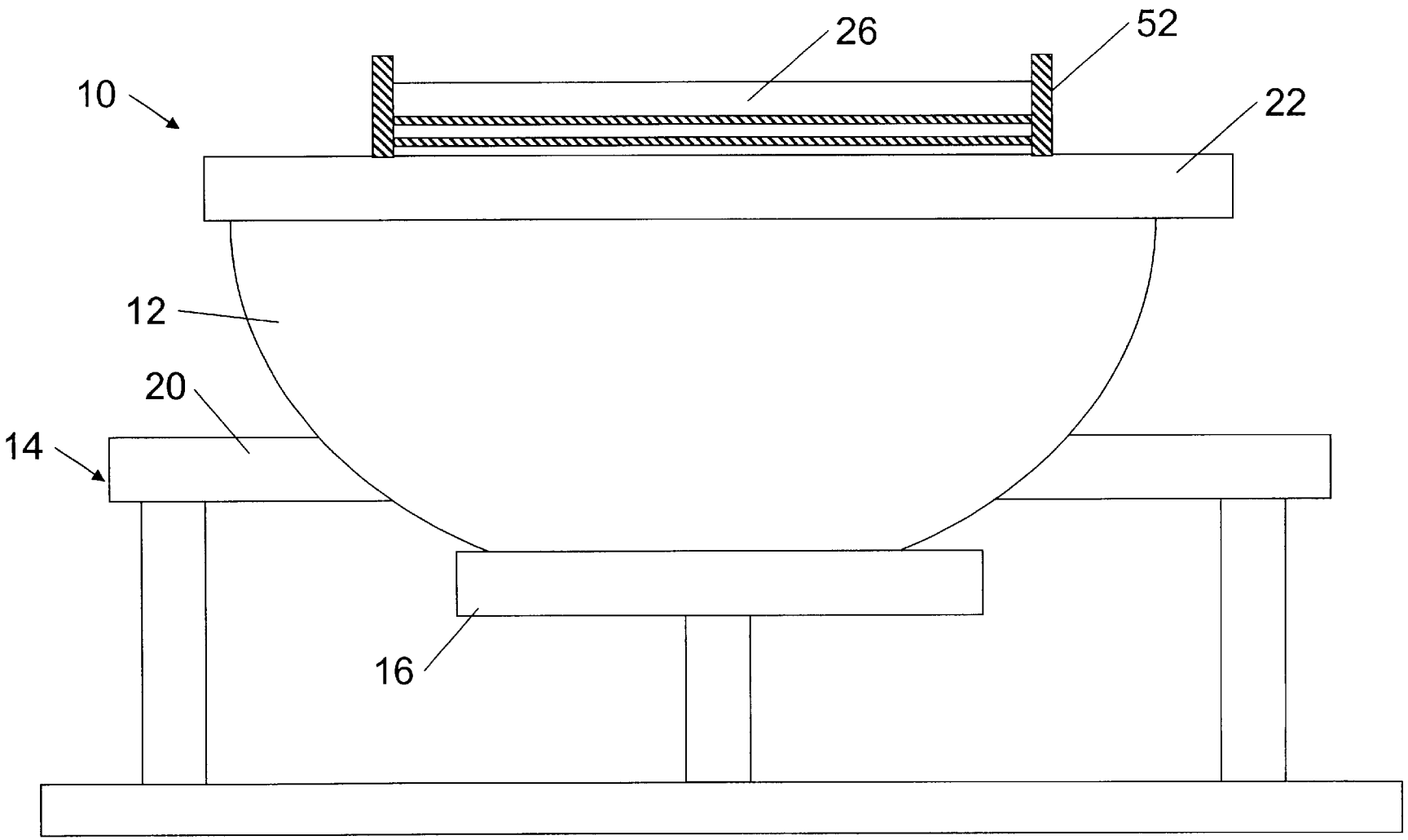
FIG. 8 is a side cross-sectional view of a restraining fence disposed on a swivel-base work platform in accordance with the present invention.

As shown in FIG. 8, the work piece 26 may alternately be secured to the work surface 22 using a restraining fence 54. The restraining fence 54 is also secured to the work surface 22 and generally provides a boundary within which the work piece 26 is manipulated during operations.

Accordingly, a relatively simple and cost-efficient device is provided that allows an operator to manipulate a work piece with minimal effort. Further, the work piece is easily secured and removed with a vacuum source that is readily accessible within a manufacturing facility. As a result, musculoskeletal injuries that occur from the continuous handling and manipulation of work pieces are substantially reduced with operation of the swivel-base work platform according to the teachings of the present invention.

The description of the invention is merely exemplary in nature and, thus, variations that do not depart from the substance of the invention are intended to be within the scope of the invention. Such variations are not to be regarded as a departure from the spirit and scope of the invention.

What is claimed is:

1. An apparatus comprising:

a base unit;

a hemisphere unit rotatably disposed within the base unit, the hemisphere unit defining a convex surface disposed between an upper portion and a lower portion;

a base plate coupled to the base unit by at least one support leg to provide access to the lower portion of the hemisphere unit; and a hard-stop disk disposed at the lower portion of the hemisphere unit, wherein when a work piece is secured to the upper portion of the hemisphere unit, the work piece can be rotatably positioned when the hemisphere unit rotates within the base unit and the hard-stop disk engages the base unit.

2. The apparatus of claim 1, wherein the base unit further comprises:

a hemisphere cradle defining a concave inner surface and an aperture, wherein the hemisphere unit is disposed within the aperture and the convex surface engages the concave inner surface.

3. The apparatus of claim 1, wherein the hemisphere unit further comprises a work surface disposed at the upper portion such that the work piece is secured to the work surface.

4. The apparatus of claim 1 further comprising a vacuum source that secures the work piece to the upper portion of the hemisphere unit.

5. The apparatus of claim 4, wherein the hemisphere unit and the hard-stop disk define concentric apertures and the vacuum source further comprises a vacuum line disposed within the concentric apertures.

6. The apparatus of claim 5 further comprising a swivel fitting disposed at an end of the vacuum line adjacent the upper portion of the hemisphere unit, wherein the hemisphere unit is rotatably disposed independent of the vacuum line.

7. The apparatus of claim 1 further comprising a magnetic source that secures the work piece to the upper portion of the hemisphere unit.

8. The apparatus of claim 1 further comprising a clamping system that secures the work piece to the upper portion of the hemisphere unit.

9. The apparatus of claim 1 further comprising at least one positioning pin that secures the work piece to the upper portion of the hemisphere unit.

10. The apparatus of claim 1 further comprising a restraining fence that secures the work piece to the upper portion of the hemisphere unit.

11. An apparatus for manipulating a work piece, the apparatus comprising:

a base unit;

a hemisphere cradle disposed on the base unit, the hemisphere cradle defining a concave inner surface and an aperture;

a hemisphere unit disposed within the aperture of the hemisphere cradle, the hemisphere unit defining a convex surface disposed between an upper portion and a lower portion, wherein the convex surface engages the concave inner surface;

a base plate coupled to the base unit by at least one support leg to provide access to the lower portion of the hemisphere unit;

a hard-stop disk disposed at the lower portion of the hemisphere unit; and a work surface disposed at the upper portion of the hemisphere unit, wherein when a work piece is secured to the work surface, the work piece can be rotatably positioned when the hemisphere unit rotates within the hemisphere cradle and the hard-stop disk engages the hemisphere cradle.

12. The apparatus of claim 11 further comprising a vacuum source that secures the work piece to the work surface.

13. The apparatus of claim 12, wherein the hemisphere unit, the work surface, and the hard-stop disk define concentric apertures and the vacuum source further comprises a vacuum line disposed within the concentric apertures.

14. The apparatus of claim 13 further comprising a swivel fitting disposed at an end of the vacuum line adjacent the work surface, wherein the hemisphere unit is rotatably disposed independent of the vacuum line.

15. The apparatus of claim 11 further comprising a magnetic source that secures the work piece to the upper portion of the hemisphere unit.

16. The apparatus of claim 11 further comprising a clamping system that secures the work piece to the upper portion of the hemisphere unit.

17. The apparatus of claim 11 further comprising at least one positioning pin that secures the work piece to the upper portion of the hemisphere unit.

18. The apparatus of claim 11 further comprising a restraining fence that secures the work piece to the upper portion of the hemisphere unit.

19. A method of manipulating a work platform, the method comprising the steps of:

(a) providing a support structure including a base coupled to a base plate by at least one support leg;

(b) securing a work piece to the work platform, the work platform comprising a hemisphere unit rotatably disposed within a hemisphere cradle which is coupled to the base;

(c) rotating the work piece to a desired position, wherein a hard-stop disk secured to a lower portion of the hemisphere unit.

20. The method of claim 19 further comprising the step of activating a vacuum source to secure the work piece to the work platform.

21. The method according to claim 19 further comprising the step of replacing the hard-stop disk with a different size hard-stop disk to adjust the amount of rotation of the work piece.

* * * * *